United States Patent [19]

Solomon

[11] Patent Number: 4,459,197

[45] Date of Patent: Jul. 10, 1984

[54] THREE LAYER LAMINATED MATRIX ELECTRODE

[75] Inventor: Frank Solomon, Great Neck, N.Y.

[73] Assignee: Diamond Shamrock Corporation, Dallas, Tex.

[21] Appl. No.: 506,228

[22] Filed: Jun. 22, 1983

Related U.S. Application Data

[63] Continuation-in-part of Ser. No. 202,585, Oct. 31, 1980, abandoned.

[51] Int. Cl.[3] ..... C25B 11/06; C25B 11/02

[52] U.S. Cl. ..... 204/292; 204/294

[58] Field of Search ..... 204/292, 294

[56] References Cited

U.S. PATENT DOCUMENTS

| | | | |
|---|---|---|---|
| 3,553,029 | 1/1971 | Kordesch et al. | 429/42 |
| 3,704,171 | 11/1972 | Landi | 429/42 X |
| 3,793,085 | 2/1974 | Hino et al. | 429/42 |
| 3,899,354 | 8/1975 | Kordesch | 429/42 |
| 4,159,367 | 6/1979 | Berchielli et al. | 429/42 X |
| 4,235,748 | 11/1980 | Berchielli et al. | 429/42 |

FOREIGN PATENT DOCUMENTS

| | | | |
|---|---|---|---|
| 1095500 | 12/1967 | United Kingdom | 429/42 |

*Primary Examiner*—John F. Niebling

*Attorney, Agent, or Firm*—Arthur S. Collins; Bruce E. Harang

[57] ABSTRACT

The active layer of an electrode is laminated on its working surface to a current distributor and on its opposite surface to a porous coherent, hydrophobic, wetproofing layer. The active layer contains from about 60 to about 85 wt. % active carbon particles bound in a matrix of a fibrillated mixture of a fluorocarbon polymer and carbon black. The electrode is useful in chlor-alkali cells.

9 Claims, No Drawings

THREE LAYER LAMINATED MATRIX ELECTRODE

This application is a continuation in part of copending application Ser. No. 202,585 filed Oct. 31, 1980 now abandoned.

BACKGROUND OF THE INVENTION

This invention relates to gas electrodes, particularly activated carbon electrodes in sheet form bonded on one side to a gas porous membrane and on the other side to an electrically conductive layer or screen. The active carbon is usually catalyzed and mixed or coated in some manner to limit the quantity of solution coming into contact with it. One side of the gas electrode is in contact with a gas which is absorbed by the electrode, electrochemically reacts within the electrode to form a non-gaseous component which then passes through the electrode into the solution which is in contact with the other side of the electrode.

As one example of the prior art see Kordesch et al, U.S. Pat. No. 3,553,029 (1971). Kordesch et al teach a three layer electrode. The wet proof layer is polytetrafluoroethylene. The platinum activated carbon layer contains a binder and is bonded to a collector. The carbon used is activated carbon having a narrow range of pore diameters. Often the relatively large pores fill with liquid, a condition known as flooding. Kordesch, U.S. Pat. No. 3,899,354 (1975), teaches a catalyst concentration for the activated carbon. Landi, U.S. Pat. No. 3,704,171 (1972) discloses that a catalytic electrode layer, having a major component of a thermoplastic having a melting point lower than the sintering temperature of the polytetrafluoroethylene minor component, is made porous by dissolving the thermoplastic resin after fibrillating the hot plastic mixture.

While the prior art electrodes were very interesting from a scientific point of view, each of them had one or more weaknesses. One of the primary weaknesses was their inability to withstand an upset. This occurs when an oxygen cathode loses its oxygen supply while under load. A second weakness of the prior art electrodes made from activated carbon and polytetrafluoroethylene has been their lack of tensile strength. A third and major problem has been flooding. Flooding occurs when the solution saturates the porous components of the electrode and gas can no longer diffuse into the electrode to react electrochemically. This reaction is severely restricted when the electrode is flooded.

The electrodes of the present invention are very good at withstanding upsets, are also very good at withstanding high stress conditions which would destroy prior art electrodes, are very good at resisting flooding, and do not require the addition of fillers to make them porous.

The reason for the improved performance of the present electrodes over the prior art, is believed to reside in the two carbon component of the present electrode. The porous and hydrophobic nature of the carbon black component allows the passage of gas but not of solution. The porous and hydrophilic nature of the active carbon allows liquid to come into contact with the high surface area carbon black where reaction can occur. It is believed that reaction occurs on the surface of both the carbon black and the activated carbon, because effective results can be obtained by catalyzing either carbon or both. The electrode also functions, but not as well, if neither carbon is catalyzed. There are also a large number of other advantages which can be enumerated if each electrode of the present invention is compared with each prior art electrode on a one to one basis.

SUMMARY OF THE INVENTION

The present invention is directed to a novel active layer in a laminated electrode laminated on its working surface to a current distributor and on its opposite surface to a porous coherent, hydrophobic, wetproofing layer.

The active layer or sheet contains from about 60 to about 85 wt.% active carbon particles having a pore diameter of from 20 to 1000 angstroms, bound in a matrix of a fibrillated mixture of 25 to 35 parts polytetrafluoroethylene and 75 to 65 parts carbon black. The carbon black has a particle size of from 50 to 2000 angstroms, and a surface area of from 25 to 1500 square meters per gram.

These active layers, per se, are described in part in U.S. Pat. No. 4,354,958 entitled "Fibrillated Matrix Active Layer For An Electrode". The disclosure of this patent is incorporated herein by reference. The present laminates can incorporate any backing layer and any current distributor, respectively, including those of the prior art disclosed herein. Of course, then such laminates will not possess the specific desirable characteristics obtainable in the specific laminates formed and referred to herein. Nevertheless, the present invention includes the active layer described in U.S. Pat. No. 4,354,958 with any wet proofing (backing) layer and any current distributor.

The term active carbon as used herein includes not only those carbons normally referred to as active carbon, but also to other forms of carbon, other than carbon black having a surface area of from 200 to 1500 square meters per gram, for example a UOP carbon known as UB104. This carbon is believed to be built on alumina, after which the alumina is leached out leaving pores. This carbon is graphitic and is a preferred form of carbon, because of its oxidation resistance.

DETAILED DESCRIPTION OF THE INVENTION

The backing (wet-proofing) layer

The three-layer laminated electrodes produced in accordance with this invention contain an outer wet proofing or backing layer, the purpose of which is to prevent electrolyte from coming through the active layer and wetting the gas side of the active layer and thereby impeding access of the oxygen (air) gas to the active layer. According to one preferred embodiment of this invention, the backing layer is formed as a coherent, self-sustaining layer sheet by passing a powdered teflon pore forming mixture through heated rollers in a single pass.

In accordance with another embodiment of this invention, the porous backing layer contains not only a pore former and polytetrafluoroethylene particles, but contains either electroconductive carbon black particles, per se, or carbon black particles which have been partially fluorinated as will be pointed out in more detail hereinafter.

When desired, one may employ a porous PTFE backing layer made by the single-pass procedure, and containing only a pore former and PTFE as claimed in copending U.S. Pat. No. 4,339,325 entitled "One Pass Process for Forming Electrode Backing Sheet". The disclosure of this patent is incorporated herein by reference.

When making such a backing layer the Teflon particles usually employed are in the form of agglomerates, such as the duPont Teflon 6 series. Teflon 6A consists of coagulates or agglomerates having a particle size of about 500 to 550 microns and were made by coagulating (agglomerating) PTFE dispersed particles of about 0.05 to 0.5 microns and having an average particle size of about 0.2 microns. These agglomerates may be partially redispersed by beating in an organic liquid medium, usually a lower alkyl alcohol, such as isopropanol, e.g., in a high speed Waring blender for about three minutes.

Pulverized sodium carbonate particles, having particle sizes ranging from about 1 to about 40 microns, and more usually from about 2 to 20 microns, and preferably having an average (Fisher Sub-Sieve Sizer) particle size of 2 to 4 microns, are added to the alcohol dispersion of the blended PTFE particles in a weight ratio ranging from about 30 to 40 parts of PTFE to about 60 to about 70 parts of sodium carbonate to result in an intimate mixture of PTFE and pore former. Then the alcohol is removed and the PTFE-$Na_2CO_3$ mix particles are dried.

Subsequent to drying, the particulate PTFE-sodium carbonate mixture is subjected to sigma mixing under conditions which mildly "fiberize" (fibrillate) the PTFE. The sigma mixing is conducted in a Brabender Prep Center Model D101 with attached Sigma Mixer with a charge of approximately 140 g. of mix. This fibrillation is performed for approximately 10 to 20 minutes at 100 rpm and 15° to 25° C.

After fibrillating and before passing the mix between rolls, the fibrillated PTFE-pore former mix is chopped for 1–20 seconds, e.g., 5 to 10 seconds.

The mildly "fiberized" chopped mixture of PTFE-sodium carbonate is then dry rolled into sheet form using a single pass through one or more sets of metal, e.g. chrome-plated steel, rolls. Temperatures of about 70° to 90° C. and roll gaps ranging from about 5 to about 10 mils are customarily employed. The conditions employed in the dry rolling are such as to avoid sintering of the PTFE particles.

Throughout this specification there appear examples. In each such example all parts, percents and ratios are by weight unless otherwise indicated.

EXAMPLE 1

Two hundred cubic centimeters of isopropyl alcohol were poured into an "Osterizer" blender. Then 49 grams of duPont 6A polytetrafluoroethylene were placed in the blender and the PTFE—alcohol dispersion was blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol (Ball milled and having an averate particle size of approximately 3.5 microns as measured by Fisher Sub-Sieve Sizer) were added to the blender. This PTFE—sodium carbonate mixture was then blended at the "blend" position in the "Osterizer" blender for three minutes followed by a higher speed blending at the "liquifying" position for an additional one minute. The resulting PTFE-sodium carbonate slurry was then poured from the blender on to a Buchner funnel, filtered, and then placed in an oven at 80° C. where it was dried for three hours resulting in 136.2 grams yield of PTFE-sodium carbonate mixture. This mixture contained approximately 35 weight parts of PTFE and 65 weight parts of sodium carbonate.

This material was then fibrillated mildly in a Brabender Prep center D101 for 15 minutes at 100 rpm and 20° C. using the Sigma Mixer Blade model 02-09-000 as described above. The thus fibrillated mixture was then chopped for 5 to 10 seconds in a coffee blender (i.e. Type Varco, Inc. Model 228.1.000 made in France) to produce a fine powder.

The chopped, fibrillated mixture was then passed through six inch diameter rolls, heated to about 80° C. and using a roll gap typically 0.008 inch (8 mils). The sheets are formed directly in one pass and are readily for use as backing layers in forming electrodes, e.g., oxygen cathodes, with no further processing beyond cutting, trimming to size and the like.

The thus formed layers are characterized as porous, (after removal of the pore-forming agent), self-sustaining, coherent, unsintered uniaxially oriented backing (wetproofing) layers of fibrillated polytetrafluoroethylene having pore openings of about 0.1 to 40 microns (depending on the size of the pore-former used and exhibit air permeability particularly well suited for oxygen (air) cathodes).

EXAMPLE 2 (Re-rolling)

The procedure of Example 1 was repeated with the exception that after the PTFE/$Na_2CO_3$ sheet was passed through the rollers once, it was folded in half and rerolled in the same direction as the original sheet. A disc of this material was pressed at 8.5 tons per square inch and 115° C. and then washed with water to remove the soluble pore former. Permeability tests conducted on this sample resulted in a permeability of 0.15 ml. of air/minutes/$cm^2$ at a pressure of one cm of water as compared to a test sample prepared according to EXAMPLE 1 and pressed and washed as above which gave a permeability of 0.21 ml of air/minutes/$cm^2$/cm of water. The permeability test was done according to the method of A.S.T.M. designation E 128-61 (Maximum Pore diameter and Permeability of Rigid Porous filters for Laboratory Use) in which the test equipment is revised to accept discs for test rather than the rigid filters for which the test was originally designed. The revision is a plastic fixture for holding the test disc in place of the rubber stopper shown in FIGS. 1 and 2 of said A.S.T.M. standard. Apparently folding and re-rolling are counterproductive to air permeability, an important and desired property in a backing layer for an oxygen cathode. Moreover, folding and re-rolling may form laminae which give rise to delamination of the backing layer in use, e.g., in a chlor-alkali cell.

EXAMPLE 3

(Single Pass with Volatile Pore Former)

A porous Teflon sheet was fabricated using a mixture of 40 wt.% ammonium benzoate (a volatile pore former) and 60 wt.% PTFE prepared as in EXAMPLE 1. The sheets were fabricated by passing the above mix (fibrillated and chopped) through the 2 roll mill once. The rolled sheet was then pressed at 8.5 tons per square inch and 65° C. The volatile pore former was then removed by heating the sheet in an oven at 150° C. Substantially all of the volatile pore former was thus sublimed leaving a pure and porous PTFE sheet. Permeability of these sheets averaged 0.2 ml of air/minute/$cm^2$ at 1 cm or water, air pressure.

CONDUCTIVE BACKING LAYER

When the laminate has a hydrophobic backing layer containing carbon particles to enhance the conductivity thereof, either unmodified carbon blacks or partially fluorinated carbon blacks, e.g., partially fluorinated acetylene black particles, can be utilized to impart conductivity to the backing layer.

The term carbon black is used generically as defined in an article entitled "FUNDAMENTALS OF CARBON BLACK TECHNOLOGY" by Frank Spinelli appearing in the August 1970 edition of *AMERICAN PRINT MAKER* to include carbon blacks of a particulate nature within the size range of 50 to 300 angstroms which includes a family of industrial carbons such as lamp blacks, channel blacks, furnace blacks, thermal blacks, etc.

A preferred form of unmodified (unfluorinated) carbon blacks in acetylene carbon black, e.g., made from acetylene by continuous thermal decomposition, explosion, by combustion in an oxygen-deficient atmosphere, or by various electrical processes. Characteristically, acetylene black contains 99.5+ weight percent carbon and has a particle size ranging from about 50 to about 2000 angstrom units. the true density of the acetylene black material is approximately 1.95 grams per cubic centimeter. Shawinigan ® acetylene black is a commercially available acetylene black having a mean particle size of about 425 angstroms with a standard deviation of about 250 angstroms. Such acetylene blacks are somewhat hydrophobic, e.g., as demonstrated by the fact that the particles thereof float on cold water but quickly sink in hot water.

The hydrophobic electroconductive electrode backing layers were prepared in accordance with this invention by combining the PTFE in particulate form as a dispersion with the carbon black particles as described above. According to a preferred embodiment of this invention, the acetylene carbon black employed is that having an average particle size of approximately 425 angstrom units with the remainder having a standard deviation of 250 angstrom units and the range of particle size is from about 50 to about 2000 Angstroms.

These acetylene black particles are mixed with PTFE particles by adding a commercially available aqueous dispersion, e.g., duPont "Teflon 30", to the carbon black, also dispersed in water to form an intimate mixture thereof. The mixture can contain from about 50 to about 80 wt.% carbon black and from about 20 to about 50 wt.% PTFE. Water is removed and the mix is dried. The dried mixture can then be heated at 275° to 300° C. for 10 to 80 minutes to remove a substantial portion of the wetting agent used to disperse the PTFE in water. Approximately 50 weight percent of this mix is fibrillated (as described above in relation to the "one pass" process) and then mixed with the remaining unfibrillated mix. A water soluble pore forming agent, e.g., sodium carbonate, can be added thereto and the carbon black, Teflon ® and pore former mixed.

Such conductive PTFE/carbon black-containing backing layers characteristically have thicknesses of 5 to 15 mils and may be produced by filtration or by passing the aforementioned acetylene black-PTFE mixes through heated rollers at temperatures of 65° to 90° C., or by any other suitable technique.

These backing layers are finally laminated with a current distributor and the active layers as disclosed herein.

EXAMPLE 4

(Preparation of PTFE/Carbon Black)

One and one-half (1.5) grams of "Shawinigan Black," hereinafter referred to as "SB", were suspended in 30 mls of hot water (80° C.) and placed in a small ultrasonic bath (Model 250, RAI Inc.) where it was simultaneously stirred and ultrasonically agitated.

Sixty-eight one hundredths (0.68) ml of DuPont "Teflon 30" aqueous PTFE dispersion was diluted with 20 mls of water and added dropwise from a separatory funnel to the SB dispersion gradually, over approximately a 10-minutes period with stirring, followed by further stirring for approximately one hour. This material was then filtered, washed with water and dried at 110° C. The dried material was spread out in a dish and heated at 300° C. in air for 20 minutes to remove the PTFE wetting agent (employed to stabilize PTFE in water dispersion in the first instance).

EXAMPLE 5

(PTFE/SB Wetproofing Layer by Filtration Method)

A PTFE/SB conductive, hydrophobic wetproofing layer or sheet was prepared by the filtration method as follows: two hundred twenty five (225) milligrams of the PTFE discontinuously coated SB, prepared in accordance with Example 4, were chopped in a small high speed coffee grinder (Varco Model 228-1, made in France) for about 30 to 60 seconds and then dispersed in 250 mls of isopropyl alcohol in a Waring Blender. This dispersion was then filtered onto a "salt paper", NaCl on filter paper, of 17 $cm^2$ area to form a cohesive, self-sustaining wetproofing layer having 10.6 mg/$cm^2$ by weight (20 mg total).

Resistivity of this wetproofing layer was measured and found to be 0.53 ohm-centimeters. The resistivity of pure PTFE (from "Teflon 30") is greater than $10^{15}$ ohm-cm by way of comparison.

The resistivity of the PTFE/SB carbon black wetproofing layer illustrates that it is low enough to be useful in forming electrodes when in intimate contact with a current distributor.

Permeability is an important factor in high current density operation of a gas electrode having hydrophobic (conductive or nonconductive) backing, viz., a wetproofing or liquid barrier layer.

The wetproofing layers of this invention have adequate permeability to be comparable to that of pure PTFE backings (even when pressed at up to 5 tons/$in^2$) yet have far superior electroconductivity.

The testing of air electrodes employing such backing layers in the corrosive alkaline environment present in a chlor-alkali cell has revealed a desirable combination of electroconductivity with balanced hydrophobicity and said layers are believed to have achieved a desired result in the oxygen (air) cathode field.

The invention will be described further in the examples which follow.

CONDUCTIVE BACKING LAYER CONTAINING PARTIALLY FLUORINATED CARBON BLACK

When in accordance with this invention, conductive backing layers are employed it is also contemplated to use partially fluorinated carbon black, e.g., the partially fluorinated carbon blacks backing layers as disclosed and claimed in U.S. Pat. No. 4,382,904 of Frank Solomon and Lawrence J. Gestaut and entitled "Electrode backing Layer and Method of Preparing". The disclosure of this patent is incorporated herein by reference. such partially fluorinated carbon blacks are preferably acetylene blacks which are subjected to partial fluorination to arrive at compounds having the formula $CF_x$, wherein x ranges from about 0.1 to about 0.18.

While hydrophobic acetylene black particles floated on cold water but quickly sank in hot water, the partially fluorinated acetylene blacks floated on hot water virtually indefinitely and could not be made to pierce the meniscus of the water.

Such hydrophobic electrode backing layers are made by combining the PTFE in particulate form as a dispersion with the partially fluorinated acetylene black particles. According to a preferred embodiment, the acetylene black employed is that having an average particle size of approximately 425 Angstrom units with a standard deviation of 250 angstrom units. The range of particle size is from about 50 to about 2000 Angstroms.

The partially fluorinated carbon black particles are suspended in isopropyl alcohol and a dilute aqueous dispersion of PTFE (2 wt.% PTFE) is added gradually thereto. This dilute dispersion is made from PTFE dispersion of 60 weight parts of PTFE in 40 weight parts of water to form an intimate mixture of $CF_x$/PTFE. The mix was then filtered, dried, treated to remove the PTFE wetting agent (by heating at 300° C. for 20 minutes in air or extracting it with chloroform) and briefly chopped to form a granular mix and then fabricated into sheet form either by (a) passing between heated rollers (65° to 90° C.) or (b) by dispersion of said PTFE/$CF_x$ particles in a liquid dispersion medium capable of wetting said particles and filtering on a salt (NaCl) bed previously deposited on filter paper or like filtration media, or (c) by spraying the mix in a mixture of water and alcohol, e.g., isopropyl, on an electrode active layer/current distributor composite assembly and drying to yield a fine pore wetproofing layer. The mixture can contain from about 50 to 80 wt.% $CF_x$ and about 20 to 50 wt.% PTFE.

In any case, a pore-former can be incorporated into the $CF_x$/PTFE mix prior to forming the wetproofing layer or sheet. The pore-former can be of the soluble type, e.g., sodium carbonate or the like, or the volatile type, e.g., ammonium benzoate or the like. The use of ammonium benzoate as a fugitive, volatile pore-former is described and claimed in U.S. Pat. No. 4,339,325. The disclosure of this patent is incorporated herein by reference.

Whether the wetproofing sheet is formed by rolling, filtration or spraying, the pore-former can be removed by washing (if a soluble one) or heating (if a volatile one) either prior to laminating the wetproofing layer to the current distributor (with the distributor on the gas side) and active layer, or after lamination thereof. In cases where a soluble pore-former is used, the laminate is preferably given a hot 50° to about 100° C. soak in an alkylene polyol, e.g., ethylene glycol or the like, prior to water washing for 10 to 60 minutes. The ethylene glycol hot soak combined with water washing imparts enhanced resistance of such laminated electrodes to blistering during water washing and is the subject matter described and claimed in U.S. Pat. No. 4,357,262 entitled "Electrode Layer treating Process". The disclosure of this patent is incorporated herein by reference.

When the wetproofing layer is formed by filtration, the filter paper/salt/wetproofing layer assembly can be laminated to the current distributor (with the filter paper side away from the current distributor and the wetproofing layer side in contact with the current distributor) followed by dissolving the salt away.

The testing of such partially fluorinated backing layers in the corrosive alkaline environment of use in a chlor-alkali cell has revealed a desirable combination of electroconductivity with balanced hydrophobicity and said layers are believed to have achieved a desired result in the oxygen (air) cathode field.

The formation and testing of the partially fluorinated carbon-containing backing layers will be described in greater detail in the examples which follow. The term "SBF" as used herein means partially fluorinated Shawinigan Black.

EXAMPLE 6

(Preparation of PTFE/$SBF_{0.17}$)

One and one-half (1.5) grams of $SBF_{0.17}$ were suspended in 30 ml of isopropyl alcohol (alcohol wets SBF). The mixture ws placed in a small ultrasonic bath, Model 250 RAI, Inc. and was simultaneously stirred and subjected to ultrasonic agitation.

Sixty-eight one-hundredths (0.68) ml. of duPont "Teflon 30" dispersion were diluted with 20 ml $H_2O$ and added dropwise from a separatory funnel to the $SBF_{0.17}$, slowly (i.e. 10 min.). After further stirring, (1 hr.), the material was filtered, washed and dried at 110° C.

A layer was made by a filtration method. Of the above material, 225 mg. was chopped in a small high speed coffee grinder, then dispersed in 250 ml. isopropyl alcohol in a Waring Blender and filtered on to a sodium chloride (salt) layer deposited on a filter paper of 19 $cm^2$ area to form a layer having an area density of 10.6 $mg/cm^2$. Resistivity was measured and found to be 8.8 ohm-cm.

The SB control strip was prepared in accordance with examples 4 and 5 above. Resistivity of this SB control strip was found to be 0.53 ohm cm. Although the resistivity of the SBF strip is 16.6 times as great as that of said control strips it is still low enough to be useful when a mesh conductor is embedded in the hydrophobic backing.

Gas permeability is an important property for high current density operation of a gas electrode having a hydrophobic conductive or non-conductive, backing layer. The SBF-PTFE backing layer prepared as above had adequate air permeability, comparable to the one pass PTFE backings of examples 1 and 3 above, even when pressed at 5 tons per square inch.

THE ACTIVE LAYER

In forming the three-layer laminate electrode of this invention, there is employed a "matrix" active layer. this matrix active layer comprises active carbon particles present within an unsintered network (matrix) of fibrillated carbon-black/polytetrafluoroethylene.

One stream (mixture), the matrixing mix component, is obtained by adding a dilute dispersion containing polytetrafluoroethylene (PTFE) e.g., duPont "Teflon 30" having a particle size of about from 0.05 to 0.5 microns in water to a mix of a carbon black, e.g., an acetylene black, and water in a weight ratio of from about 25 to 35 weight parts of PTFE to from about 65 to about 75 weight parts of carbon black to form an intimate mix of PTFE/carbon black particles; drying the aforementioned mixture and heat treating it to remove the PTFE wetting agent thereby resulting in a first component mix. The carbon black can optionally be catalyzed using the same procedure set forth below for the active carbon.

The second component, the active carbon-containing catalyst component, is comprised of an optionally catalyzed, preferably previously deashed and optionally classified active carbon, having a particle size ranging from about 1 to about 30 microns and more usually from about 10 to about 20 microns.

Deashing can be done by pretreatment with caustic and acid to remove a substantial amount of ash from the active carbon prior to catalyzing same. The term ash refers to oxides principally comprised of silica, alumina, and iron oxides. The deashing of active carbon constitutes the subject matter of co-pending U.S. patent application entitled "Active Carbon Conditioning Process", Ser. No. 202,580, filed on Oct. 31, 1980, now U.S. Pat. No. 4,379,077 in the name of Frank Solomon as inventor. The disclosure of this application is incorporated herein by reference. The thus deashed, classified, active carbon particles can then be catalyzed with a precious metal, e.g. by contacting with a silver or platinum precursor followed by chemical reduction with or without heat to deposit silver, platinum or other respective precious metal on the active carbon. The catalyzed carbon can be filtered, dried at temperatures ranging from about 80° C. to 150° C., with or without vacuum, to produce a second (active carbon catalyst) component or mixture.

These mixtures are then chopped together, with or without the addition of a particulate, subsequently removable pore-forming agent and then shear blended (fibrillated) at temperatures ranging from about 40° to about 60° C. for 2 to 10 minutes, e.g. 4 to 6 minutes in the presence of a processing aid or lubricant, e.g., a 50:50 mixture (by weight) of ispopropyl alcohol and water, when a soluble pore former is not used in the mixture. When a water-soluble pore former is used, the lubricant can be isopropyl alcohol alone. The previously chopped mixture can be fibrillated using a mixer having a Sigma or similar blade. During this fibrillation step, the chopped mixture of the two-component mixes is subjected to shear blending forces, viz., a combination of compression and attenuation which has the effect of substantially lengthening the PTFE in the presence of the remaining components. This fibrillation is believed to substantially increase the strength of the resulting sheets formed from the fibrillated mixed components. After such fibrillating, the mixture is noted to be fibrous and hence, the term "fiberizing" is used herein as synonymous with fibrillating.

Subsequent to fibrillation, the mixture is dried, chopped for from one to ten seconds into a fine powder and formed into a sheet by rolling at 50° C. to 100° C. or by deposition on a filter. A pore-former, if one is employed as a bulking agent, can be then removed prior to electrode fabrication. In the event no pore former is employed, the matrix active layer sheet can be used (as is) as the active catalyst-containing layer of an oxygen (air) cathode, e.g., for use in a chlor-alkali cell, fuel cell, etc.

The active layers used in the laminates of the present invention result in electrodes which can be used longer and are more stable in use because of greater active layer strength, resistance to blistering and other failures do to insufficient strength.

Tensile strength tests of the coherent, self-sustaining active layer sheets rolled from the fiberized material characteristically displayed approximately 50% greater tensile strength than unfiberized sheets. Life testing of electrodes employing the fibrillated (fiberized) active layer sheets of this invention resulted in approximately 8900 hours life at 300 milliamps/cm$^2$ in 30% hot (60° to 80° C.) aqueous sodium hydroxide before failure. In addition to the advantages of longevity and strength, this process is easy to employ in making large batches of active layer by continuous rolling of the fibrillated mix resulting in a material uniform in thickness and composition. Furthermore, the process is easy to administer and control.

In accordance with one preferred embodiment of this invention, the pore-forming agent can be added later, when the carbon black-PTFE mix and the catalyzed active carbon particles are mixed together and chopped.

The invention will be illustrated in further detail in the examples which follow in which all percents, ratios and parts are by weight unless otherwise indicated.

EXAMPLE 7

(A matrix active layer containing silver catalyzed active carbon particles.)

Commercially available ball milled Calgon "RB carbon" was found to have an ash content of approximately 12% as received. This "RB carbon" was treated in 38% KOH for 16 hours at 115° C. and found to contain 5.6% ash content after a subsequent furnace operation. The alkali treated "RB carbon" was then treated (immersed) for 16 hours at room temperature in 1:1 aqueous hydrochloric acid (20% concentration). The resulting ash content had been reduced to 2.8%. "RB carbon", deshed as above, was silvered in accordance with the following procedure:

Twenty (20 g) grams of deashed "RB carbon" were soaked in 500 ml of 0.161 N (normal) aqueous $AgNO_3$ with stirring for two hours. The excess solution was filtered off to obtain a filter cake. The retrieved filtrate was 460 ml of 0.123 N $AgNO_3$. The filter cake was rapidly stirred into an 85° C. alkaline formaldehyde solution, prepared using 300 cc (cubic centimeters) water, and 30 cc of 30% aqueous NaOH and 22 cc of 37% aqueous $CH_2O$, to ppt. Ag in the pores of the active carbon.

Calculation indicated that 79% of the 2.58 grams of retained silver in the catalyst was derived from adsorbed silver nitrate.

Separately, "Shawinigan Black", a commercially available acetylene carbon black, was mixed with "Teflon 30" (duPont polytetrafluoroethylene dispersion), using an ultrasonic generator to obtain intimate mixture. 7.2 grams of the carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of a 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a Bolling rubber mill. The resulting mixture active layer sheet had an area density of 22.5 milligrams per square centimeter and was ready for lamination.

EXAMPLE 8

(A matrix active layer containing platinum catalyzed active carbon particles)

The procedure of Example 7 was repeated except that platinium was deposited on the deashed active ("RB") carbon instead of silver. The 10 to 20 micron classified deashed "RB" carbon had platinum applied thereto in accordance with the procedure described in U.S. Pat. No. 4,044,193 using $H_3Pt(SO_3)_2OH$ to deposit 1 part platinum per 34 parts of deashed active carbon.

After fibrillation and upon rolling, the area density of the active layer was determined to be 22.2 milligrams per $cm^2$. This matrix active layer was then ready for lamination.

EXAMPLE 9

(A matrix active layer containing silver catalyzed active carbon particles without heat treatment before fibrillation)

An active layer containing deashed, silvered "RB" active carbon was prepared as in Example 7 with the exception that the 70/30 (by weight) "Shawinigan Black/"Teflon 30" matrixing material was not heat treated before fibrillating. This matrix active layer was heavier than those prepared according to Examples 7 and 8. It had an area density of 26.6 milligrams per $cm^2$ and was ready for lamination.

EXAMPLE 10

(A matrix active layer containing platinum catalyzed active carbon particles incorporating a pore former and heat treated, as in Examples 7 and 8, before fibrillation)

This matrix active layer was made according to the basic procedure of Example 7 using deashed "RB" active carbon platinized by the method of U.S. Pat. No. 4,044,193 to a level of 19 weight parts of deashed "RB" active carbon per weight part platinum. Six grams of ultrasonically teflonated (70:30, "Shawinigan black":PTFE) carbon black were heat treated for 20 minutes at 525° F. prior to addition thereto of 15 grams of said active carbon along with 9 grams of sodium carbonate, which had been classified to the particle size range of +5 to −10 microns. This material was fibrillated and rolled out as in Example 1 and extracted by water (to remove the sodium carbonate) after first hot soaking it in ethylene glycol at 75° C. for 20 minutes.

The resulting active layer sheet was a very poor porous and light weight material.

THE CURRENT DISTRIBUTOR (CURRENT DISTRIBUTOR) LAYER

The current distributor layer, which is usually positioned next to and laminated to the working surface of the active layer of the three-layer laminate, can be an asymmetric woven wire mesh wherein the material from which the wire is made is selected from the group consisting of nickel, nickel-plated copper, nickel-plated iron, silver-plated nickel, and silver-plated, nickel-plated copper and like materials. In such asymmetric woven wire mesh current distributors, there are more wires in one direction than in the other direction.

The current distributor or collector utilized in accordance with this invention can be a woven or non-woven, symmetrical or asymmetric wire mesh or grid. Generally, there is a preferred current carrying direction. When the current distributor is a woven wire mesh, there should be as few wires as feasible in the non-current carrying direction. There will be found to be a minimum required for fabrication of a stable wire cloth. A satisfactory asymmetric wire cloth configuration may consist of e.g., 50 wires/inch in the warp direction but only 25 wires per inch in the fill, thus maximizing the economy and utility of the wire cloth, simultaneously.

These asymmetric woven wire current distributors referred to hereinabove are described and claimed in U.S. Pat. No. 4,354,917 and entitled "Asymmetric Current distributor", the disclosure of which is incorporated herein by reference. Such asymmetric woven wire mesh current distributors are useful as the current distributor in the three layer laminates of this invention which are useful as oxygen cathodes in chlor-alkali cells.

Alternatively, the current distributor can be of the porous plaque type, viz., a comparatively compact yet porous layer, having porosity ranging from about 30 to about 80% and made of powders of Ni, Ag or the like.

FORMING THE THREE-LAYER LAMINATES

The three-layer laminates produced in accordance with this invention usually have the active layer centrally located, viz., positioned in the middle; between the backing layer on the one side and the current distributor (collector) layer on the other side. The three layers arranged as described, are laminated using heat and pressure at temperatures ranging from about 100 to about 130° C. and pressures of 0.5 to 10 T/$in^2$ followed by removal from the pressing device. The laminates are preferably then subjected to a hot soaking step in ethylene glycol or equivalent polyol to enhance removal of the pore-forming agent(s) employed to form the aforementioned backing (wetproofing) layer and any bulking and/or pore forming agent optionally included in the active layer.

The laminating pressures will depend on whether or not electro-conductive (carbon black) particles have been included in the backing layer along with the PTFE. Thus when using a backing layer of pure "Teflon", viz., "Teflon ®" with pore former only, pressures of 4 to 8 T/$in^2$ and temperatures of 90° to 130° C. are customarily employed. Upon lamination the current collector is deeply embedded in the active layer.

On the other hand when using electroconductive carbon black particles in the backing layer, pressures as low as 0.5 to 2 T/in$^2$, and more characteristically as low as 1 T/in$^2$ have been determined to be adequate to effect the bonding of the conductive backing to the active layer and the active layer to the backing layer. Of course, higher laminating pressures can be employed so long as the porosity is not destroyed.

EXAMPLE 11

Example 7 was repeated with the the following exceptions. The active carbon was not catalyzed, and the carbon black was catalyzed with platinum. The carbon black used was Ketjenblack having a surface area of over 900 square meters per gram. The carbon black was hydrophobic, and consisisted of aggregates of particles having a particle size (diameter or width) of 0,035 microns. The procedure used to catalyze the carbon black was as in Example 8 except that the ratio of carbon to platinum is changed from 9 to 19 parts carbon black to 1 part platinum, by weight.

The active layer produced was laminated into a three layer electrode according to the teaching of the present application using the backing layer of Example 1, and successfully performed at 250 milliamps per square centimeter for over a year. The test conditions were as follows. A 1 square inch electrode was made cathodic in 33% NaOH, at a temperature of 80° C. Air, scrubbed free of $CO_2$, was passed across the side of the cathode at 4 times the stoichiometric requirement and then vented.

EXAMPLE 12

This example is basically the same as Example 11 except that UB104, a product of UOP, was used in place of the RB carbon. UB104 consists of large porous particles like RB carbon, but has a surface area of about 265 square meters per gram and is more oxidation resistant since the carbon has a graphitic structure. UB104 carbon is hydrophilic.

The electrode produced by the example had satisfactory performance as an oxygen electrode. The electrode was on test for 150 days at 400 milliamps/sq. cm before failure under test conditions similar to Example 11.

When Example 12 was repeated without the carbon black, the electrode failed after a few days, apparently by flooding.

When Example 12 was repeated without the UB104 active carbon, additional pores had to be generated in the electrode structure for the electrode to work in a satisfactory manner.

The three-layer laminated electrodes of this invention can be formed using a variety of the aforementioned backing layers and current distributors. The following examples further illustrate their preparation and actual testing in corrosive alkaline environments and at current densities such as are employed in chlor-alkali cells, fuel cells, batteries, etc.

EXAMPLE 13

(Forming laminated electrodes from the matrix active layers of Examples 7-9 and testing them in alkaline media at current densities of 250 milliampers per square centimeter and higher)

The active layers prepared in accordance with Examples 7 to 9, respectively, were each laminated to a current distributor and a backing sheet of sodium carbonate-loaded PTFE prepared per Example 1.

The current distributor was a 0.004 inch diameter nickel woven wire mesh having a 0.0003 inch thick silver plating and the woven strand arrangement tabulated below. The distributor was positioned on one active layer side while the backing layer was placed on the other side of the active layer.

The lamination was performed in a hydraulic press at 100° to 130° C. and using pressures of 4 to 8.5 tons per in$^2$ for several minutes. These laminates were then hot soaked in ethylene glycol at 75° C. for 20 minutes before water washing at 65° C. for 18 hours and then dried.

The laminates were then placed in respective half cells for testing against a counter electrode in thirty percent aqueous sodium hydroxide at temperatures of 70° to 80° C. with an air flow of four times the theoretical requirement for an air cathode and at a current density of 300 milliamperes per cm$^2$. The testing results and other pertinent notations are given below.

TABLE 1

| Active Layer Examp. | Type of Ag Plated Ni Mesh | Initial Voltage vs/Hg/HgO Ref. Electrode | Useful Life of Matrix Electrode (hrs) | Voltage at Failure |
|---|---|---|---|---|
| 7 | 58 × 60 × .004 | −0.265 volts | 8,925 | −.395 volts(1) |
| 8 | 50 × 5O × .005 | −0.201 volts | 3,512+ | N.S.(2) |
| 9 | 58 × 60 × .004 | −0.282 volts | 3,861 | −.509 volts(3) |

(1)Shortly after 8925 hours there was a steep decline in potential and the electrode was judged to have failed.
(2)After 188 days, its voltage was −0.246 volts compared to the Hg/HgO reference electrode (a very slight decline in potential) and this matrix electrode is still on life testing. After being started at 300 milliamperes per cm$^2$, the test current density was changed to 250 milliamperes/cm$^2$.
(3)The final failure was caused by separation of the current distributor from the face of the electrode.

EXAMPLE 14

A laminated electrode was formed using the PTFE/-sodium carbonate one pass backing layer of Example 1, the active layer of Example 7 and a prior art type porous sintered nickel plaque current distributor (Dual Porosity Lot. No. 502-62-46). The matrix active layer was positioned on the coarse side of said plaque and the PTFE/sodium carbonate backing layer was placed on top of the other surface of the active layer. This sandwich was pressed at 8.5 tons/in$^2$ and 115° C. for three minutes after which it was hot soaked in ethylene glycol at 75° C. for 20 minutes followed by water washing at 65° C. for 18 hours. This air electrode was operated at four times theoretical air and 250 milliamperes/cm$^2$ in 30% NaOH at 70° C. and operated satisfactorily for 17 days before failure.

What is claimed is:

1. In a laminated electrode, having an active layer, laminated on its working surface to a current distributor and on its opposite surface to a porous coherent, hydrophobic, wetproofing layer, the improvement comprising; the active layer or sheet containing from about 60 to about 85 wt.% active carbon particles having a pore diameter of from 10 to 1000 angstroms, bound in a matrix of a fibrillated mixture of a fluorocarbon polymer and carbon black, the carbon black being present at a level of from 13 to 45 parts of carbon black per hundred parts of the mixture, the carbon black having a particle size of from 50 to 3000 angstroms, and a surface area of from 20 to 1500 square meters per gram.

2. The electrode of claim 1 wherein the carbon black is catalyzed.

3. The electrode of claim 1 wherein the active carbon is catalyzed.

4. An electrode as in claim 3 wherein the catalyst is silver.

5. The electrode of claim 1 wherein both carbons are catalyzed.

6. The electrode of claim 1 wherein the active carbon is graphitized.

7. The electrode of claim 1 wherein the carbon black is hydrophobic.

8. The electrode of claim 1 wherein the active carbon is hydrophilic.

9. A laminated electrode as in claim 2 wherein the catalyst is silver.

* * * * *